US006579828B1

(12) United States Patent
Hamada et al.

(10) Patent No.: US 6,579,828 B1
(45) Date of Patent: Jun. 17, 2003

(54) MULTI CHROMATIC THERMALLY SENSITIVE RECORDING MEDIUM

(75) Inventors: Kaoru Hamada, Shinjuku-ku (JP); Tadakazu Fukuchi, Shinjuku-ku (JP); Yoshimi Midorikawa, Shijuku-ku (JP); Yoshihide Kimura, Shinjuku-ku (JP)

(73) Assignee: Nippon Paper Industries Co. LTD, Tokyo (JP)

( * ) Notice: Subject to any disclaimer, the term of this patent is extended or adjusted under 35 U.S.C. 154(b) by 185 days.

(21) Appl. No.: 09/680,928

(22) Filed: Oct. 10, 2000

(30) Foreign Application Priority Data

Oct. 15, 1999 (JP) ..... 11-293947
Dec. 13, 1999 (JP) ..... 11-353159

(51) Int. Cl.[7] ..... B41M 5/30; B41M 5/34
(52) U.S. Cl. ..... 503/216; 503/204; 503/226
(58) Field of Search ..... 503/204, 216, 503/226

(56) References Cited

U.S. PATENT DOCUMENTS 4,638,340 A * 1/1987 Iiyama et al. ..... 503/204
6,037,308 A 3/2000 Sato et al.

FOREIGN PATENT DOCUMENTS

WO WO 97/16420 5/1997

* cited by examiner

*Primary Examiner*—Bruce H. Hess
(74) *Attorney, Agent, or Firm*—Sherman & Shalloway

(57) ABSTRACT

A multi chromatic thermally sensitive recording medium comprising, a higher temperature color developing layer containing dye precursor and an organic color developer that reacts with said dye precursor and develops color by heating, and at least one lower temperature color developing layer that develops different color from that of said higher temperature color developing layer and develops color by lower temperature than the color developing temperature of said higher temperature color developing layer laminated in order on a substrate, wherein an organic color developer contained in said higher temperature color developing layer contains said diphenylsulfone bridgeable type compound represented by general formula (1) and/or said 3-{[(phenylamine)carbonyl]amino}benzenesulfoneamide compound represented by general formula (2), (1)

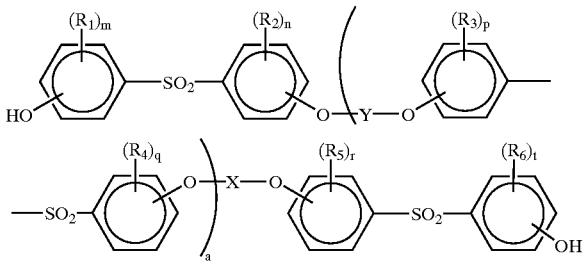

wherein, X and Y can be different and indicates a saturate or an unsaturated liner or grafted hydrocarbon group of carbon number 1 to 12 which can possess an ether bond, or (a)

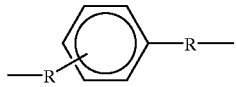

or, (b)

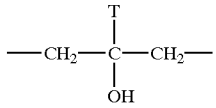

wherein R indicates a methylene group or an ethylene group, T indicates a hydrogen atom or an alkyl group of carbon number 1 to 4, and $R_1$ to $R_6$ independently indicate a halogen atom, an alkyl group of carbon number 1 to 6 or an alkenyl group, further m, n, p, q, r, t indicate an integer number of 0 to 4 and when are bigger than 2, $R_1$ to $R_6$ can be different and a is an integer of 0 to 10.

(2)

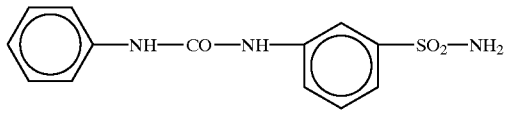

3 Claims, No Drawings

MULTI CHROMATIC THERMALLY SENSITIVE RECORDING MEDIUM

BACKGROUND OF THE INVENTION

The present invention relates to a multi chromatic thermally sensitive recording medium, more in detail relates to a multi chromatic thermally sensitive recording medium having plural color developing layer which develops different color tones by different heating conditions of thermal head.

DESCRIPTION OF THE PRIOR ART

In general, a thermally sensitive recording media having a thermally sensitive color developing layer mainly composed of colorless or pale colored electron donning type dye precursor (hereinafter shortened to dye precursor) and color developer that develops color by reacting with dye precursor when heated, is disclosed in Japanese Patent Publication 45-14035 and is widely used in a commercial scale. As a method for recording of this thermally sensitive recording medium, usually, a thermal printer in which a thermal head is installed is used. This kind of thermal recording method is superior to a conventional recording method from the view point of noiseless at recording process, does not need a developing and fixing processes, maintenance free, equipment is relatively cheap and compact and the obtained image is very clear. Therefore, this method is widely applied in the field of a facsimile or a computer, various kinds of measuring instrument and for a labeling machine along with the growth of an information industry. Along with the expanding of the usage, the required qualities to a thermally sensitive recording medium are becoming more multiplex, for instance, a higher sensitivity, a stabilization of image and a multi coloration of image can be mentioned. Especially, the multi coloration of recorded image have a merit that the letters or patterns to be emphasize can be recorded by a different color tone from the other part.

As a multi chromatic thermally sensitive recording medium, for example, a method to prepare plural color developing layers that develop different colors on a substrate and to form a recording image using variations of heating temperature or thermal energy can be mentioned. The structural feature of said thermally sensitive recording medium is characterized to laminate the layers in order from a higher temperature color developing layer to a lower temperature color developing layers that develops color by lower temperature or lower thermal energy than said higher temperature color developing layer. These multi chromatic thermally sensitive recording media can be mainly divided to two different types, that is, a color discharging type and a color adding type.

The color developing mechanism of the color discharging type is disclosed in e.g. Japanese Patent Publication 50-17865, Japanese Patent Publication 57-14320 or Japanese Patent Laid Open Publication 2-80287. That is, only a lower temperature color developing layer develops color by lower temperature heating, and when heated by higher temperature, the color developed by lower temperature is discharged by the action of color discharging agent having color discharging effect, and only a higher color developing layer develops color. This method has a merit that the desired color tone can be selected voluntarily, however, it is necessary to add large amount of color discharging agent to perform a sufficient color discharging effect. The color discharging type multi chromatic thermally sensitive recording medium have problems, that is, the deterioration of recorded image preservability caused by added large amount of color discharging agent or the deterioration of recording sensitivity caused by a large consumption of thermal energy necessary for melting the achromatic agent.

Meanwhile, as the example of a color adding type thermally sensitive recording medium, the methods disclosed in Japanese Patent Publication 49-27708, Japanese Patent Publication 51-19989 or Japanese Patent Laid Open Publication 51-146239 can be mentioned. That is, the methods to obtain distinguishable two color images by adding different thermal energy to a double layered color developing layer which develops different two colors are disclosed. In the methods disclosed above, a lower temperature developing layer located at the upper position develops color by lower heating temperature, and a higher temperature developing layer located at the bottom position develops color by higher heating temperature, thus both two color developing layers develop colors. And, since in the obtained image these two colors of said two layers are mixed, it is substantially necessary to make the color of the layer located at the bottom position black. Further, since the black color image of bottom layer is obtained by mixing with the color of an upper layer, the color of an upper layer is fogged over the black color image and the difference between said two developed color tones is not so clear. Furthermore, there are problems that when the developed color is exposed to the high temperature atmosphere, for example on a dash board of car, the higher temperature developing layer develops color and a color tone developed by lower temperature becomes fogging or becomes black. In Japanese Patent Laid Open Publication 4-329186, there is a description that the color cloudy problem caused by color developing of a higher temperature color developing layer at the lower temperature heating can be solved by containing specific color indicator in a higher temperature color developing layer. However, this method is not sufficient at the clearness of color tone developed at lower temperature in high temperature atmosphere and the stability of ground color. Still further, recently, the case to use a thermally sensitive recording paper as a receipt becomes more popular, in which case the preservability of recorded image becomes necessary. However, a thermally sensitive recording paper having sufficient image preservability is not yet developed up to the present time.

BRIEF SUMMARY OF THE INVENTION

The object of this invention is to provide a multi chromatic thermally sensitive recording medium that can obtain clear color developed images both at a lower temperature color developing layer and a higher color developing layer, further the obtained color image developed at lower temperature does not become fogging by the color tone of higher temperature color developing layer at the high temperature atmosphere, furthermore the image preservability is excellent.

The present invention is a multi chromatic thermally sensitive recording medium comprising, a higher temperature color developing layer containing dye precursor and an organic color developer that reacts with said dye precursor and develops color by heating, and at least one lower temperature color developing layer that develops different color from that of said higher temperature color developing layer and develops color by lower temperature than the color developing temperature of said higher temperature color developing layer laminated in order on a substrate, wherein an organic color developer contained in said higher temperature color developing layer contains at least one compound selected from the group consisted of diphenylsulfone bridgeable type compound represented by general formula (1), which is disclosed in WO97/16420, and 3-{[(phenylamine)carbonyl]amino}benzenesulfoneamide compound represented by general formula (2), which is disclosed in Japanese Patent Laid Open Publication 8-59603, (1)

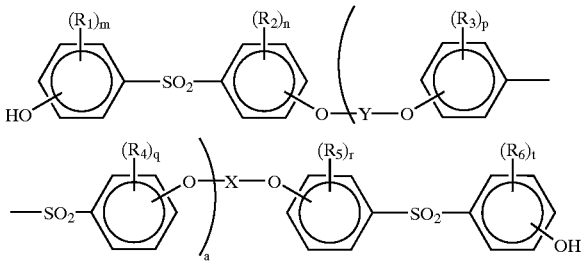

wherein, X and Y can be different and indicates a saturate or an unsaturated liner or grafted hydrocarbon group of carbon number 1 to 12 which can possess an ether bond, or (a)

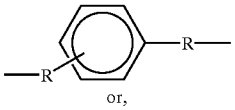

or, (b)

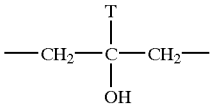

wherein R indicates a methylene group or an ethylene group, T indicates a hydrogen atom or an alkyl group of carbon number 1 to 4, and $R_1$ to $R_6$ independently indicate a halogen atom, an alkyl group of carbon number 1 to 6 or an alkenyl group, further m, n, p, q, r, t indicate an integer number of 0 to 4 and when are bigger than 2, $R_1$ to $R_6$ can be different and a is an integer of 0 to 10.

(2)

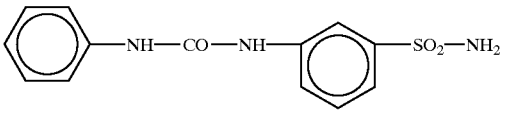

Further, in the present invention, the lower temperature color developing layer which develops different color from that of the higher temperature color developing layer and develops color by lower temperature than that of the color developing temperature of said higher temperature color developing layer is not restricted to only one layer, and laminated from higher ones to lower ones in order on a substrate, thus the multi chromatic thermally sensitive recording medium can be obtained.

The multi chromatic thermally sensitive recording medium which develops more than 2 colors can be easily affected by variations of temperature environment, because of it's color developing mechanism which used difference of heating temperature or thermal energy. In a case of the color tone developed by lower temperature formed by lower temperature heating (lower energy printing), for the purpose to maintain the clearness of color tone in higher level, it is important to control the effect of color developing of the higher temperature color developing layer to the lowest level. As the countermeasure to prevent the partial color developing of the higher temperature color developing layer at the lower heating temperature, the raising of the melting point of the color developer used in the higher temperature color developing layer is concerned to be effective.

However, even if the color developer having higher melting point is used, at the lamination process of a higher color developing layer and a lower color developing layer, both layers are partially mixed at the boarder, and generates melting point dropping phenomenon. Therefore, compared with the cases that a higher temperature color developing layer or a lower temperature color developing layer is independently prepared on the substrate, the stability of ground color to a heat is remarkably deteriorated and also the whiteness becomes bad. For example, in cases when 2,4'-dihydroxydiphenylsulfone or 4,4'-dihydroxy diphenylsulfone which are the conventional well-known color developer having high melting point, since the color developing of ground color is generated at the atmosphere of 60° C. around temperature, the stability of the ground color is not so sufficient.

In the meanwhile, the inventors of this invention have found that by containing at least one kind of compound selected from the group consisted of diphenylsulfone type bridgeable compound represented by general formula (1) or 3-{[(phenylamine)carbonyl]amino}benzenesulfoneamide compound represented by general formula (2) in a higher temperature color developing layer, the ground color development at high temperature atmosphere is prevented, the fogging to the lower temperature developed color image by the higher temperature color developing layer is improved, and further the preservability of the image developed at higher temperature is remarkably improved, and accomplished the present invention. The reason why the excellent function and effect are obtained by the present invention is not made clear. By the way, diphenylsulfone type bridgeable type compound represented by general formula (1) and 3-{[(phenylamine)carbonyl]amino}benzenesulfone -amide compound represented by general formula (2) are especially superior in the stability to heat compared with the conventional phenol type color developer. Therefore, when they are contained in a higher temperature color developing layer, the fogging by the higher temperature color developing layer to the image developed by lower temperature becomes small, further do not develop color even if they are placed in high temperature atmosphere. And it is concerned that this is the reason why the multi chromatic thermally sensitive recording medium of this invention can maintain the color tone of the lower temperature color developed image clearly. Further, when the diphenylsulfone type bridgeable type compound represented by general formula (1) is use, the stability of obtained image to the solvent such as oil or plasticiser are remarkably higher compared with that of conventional phenol type color developer. The reason why is not clear yet, however, the presumed reasons are mentioned below. First, the bonding strength with leuco dye is high because it has plural numbers of sulfonic group in the molecular, second, the solubility of a kind of complex formed when it reacts with leuco dye to these solvents is low.

DETAILED DESCRIPTION OF THE INVENTION

In the multi chromatic thermally sensitive recording medium of this invention, the color tone of each color developing layer are adjusted by the selection of leuco dye which is a dye precursor. And, for example, in a case of two colored thermally sensitive recording medium, it is desired to select a mono tone color (e.g. blue, red or yellow) dye whose absorption peak after color developed is single for a lower temperature color developing layer and to select a multi tone color (e.g. green or black) dye whose absorption peak after developed by mixed color tone is plural for a higher temperature color developing layer.

In a case to use a black type leuco dye to a higher temperature color developing layer of this invention, especially 3-diethylamino-7-(o-chloroanilino)fluoran, 3-diethylamino-6-methyl-7-anilinofluoran, 3-dibutylamino-6-methyl-7-anilinofluoran, 3-dibutylamino-7-(o-chloroanilino)fluoran, 3-di-n-pentylamino-6-methyl-7-anilinofluoran, 3-(N-ethyl-p-toluidino)-6-methyl-7-anilinofluoran and 3-(N-ethyl-N-isoamylamino)-6-methyl-7-anilinofluoran are desirably used because when used together with diphenylsulfone type bridgeable type compound represented by general formula (1) or 3-{[(phenylamine) carbonyl]amino}benzenesulfoneamide compound represented by general formula (2) do not develop color at lower temperature heating and do not cause the problem of fogging to the image developed by lower temperature, further, very clear black colored image can be obtained at high temperature heating. Especially, among these compounds following compounds, that is, 3-diethylamino-7-(o-chloroanilino)fluoran, 3-dibutylamino-7-(o-chloroanilino)fluoran and 3-(N-ethyl-p-toluidino)-6-methyl-7-anilinofluoran are desirably used, because a thermally sensitive recording medium whose ground color developing at the preservation in high temperature condition becomes very small can be obtained.

Besides above mentioned compounds, as the leuco dye used in the present invention, the conventional well known dyes in the field of a pressure sensitive type or a thermally sensitive recording paper can be used. Desirably, triphenyl methane type compound, fluoran type compound, fluorene type compound and divinyl type compound can be used, however, not intended to be limited to them. Typical examples of basic colorless dye are mentioned below. Further, these dye precursors can be used alone or together with.

<Triphenylmethane Type Leuco Dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran Type Leuco Dyes>

3-diethylamino-6-methylfluoran 3-diethylamino-6-methyl-7-anilinofluoran 3-diethylamino-6-methyl-7-(o,p-dimethylanilino)fluoran 3-diethylamino-6-methyl-7-chlorofluoran 3-diethylamino-6-methyl-7-(m-trifluoromethylanilino) fluoran 3-diethylamino-6-methyl-7-(m-methylanilino)fluoran 3-diethylamino-6-methyl-7-(o-chloroanilino)fluoran 3-diethylamino-6-methyl-7-(p-chloroanilino)fluoran 3-diethylamino-6-methyl-7-(o-fluoroanilino)fluoran 3-diethylamino-6-methyl-7-n-octylanilinofuoran 3-diethylamino-6-methyl-7-n-octylaminofluoran 3-diethylamino-6-methyl-7-benzylanilinofluoran 3-diethylamino-6-methyl-7-dibenzylanilinofluoran 3-diethylamino-6-chloro-7-methyl fluoran 3-diethylamino-6-chloro-7-anilinofluoran 3-diethylamino-6-chloro-7-p-methylanilinofluoran 3-diethylamino-6-ethoxyethyl-7-anilinofluoran 3-diethylamino-7-methylfluoran 3-diethylamino-7-dibenzylaminofluoran 3-diethylamino-6,8-dimethylfluoran 3-diethylamino-7-chlorofluoran 3-diethylamino-7-(m-trifluoromethylanilino)fluoran 3-diethylamino-7-(o-chloroanilino)fluoran 3-diethylamino-7-(p-chloroanilino)fluoran 3-diethylamino-7-(o-fluoroanilino)fluoran 3-diethylamino-benzo[a]fluoran 3-diethylamino-benzo[c]fluoran 3-dibutylamino-6-methyl-fluoran 3-dibutylamino-6-methyl-7-anilinofluoran 3-dibutylamino-6-methyl-7-(o,p-dimethylanilino)fluoran 3-dibutylamino-6-methyl-7-(o-chloroanilino)fluoran 3-dibutylamino-6-methyl-7-(p-chloroanilino)fluoran 3-dibutylamino-6-methyl-7-(o-fluoroanilino)fluoran 3-dibutylamino-6-methyl-7-(m-trifluoromethylanilino) fluoran 3-dibutylamino-6-methyl-7-chlorofluoran 3-dibutylamino-6-methyl-7-bromofluoran 3-dibutylamino-6-ethoxyethyl-7-anilinofluoran 3-dibutylamino-6-chloro-7-anilinofluoran 3-dibutylamino-6-methyl-7-p-methylanilinofluoran 3-dibutylamino-7-(o-chloroanilino)fluoran 3-dibutylamino-7-(o-fluoroanilino)fluoran 3-di-n-pentylamino-6-methyl-7-anilinofluoran 3-di-n-pentylamino-6-methyl-7-(p-chloroanilino)fluoran 3-di-n-pentylamino-7-(m-trifluoromethylaniliono)fluoran 3-di-n-pentylamino-6-chloro-7-anilinofluoran 3-7di-n-pentylamino-7-(p-chloroanilino)fluoran 3-pyrrolidino-6-methyl-7-anilinofluoran 3-piperidino-6-methyl-7-anifinofluoran 3-(N-methyl-N-propylamino)-6-methyl-7-anilinofluoran 3-(N-methyl-N-cyclohexylamino)-6-methyl-7-anilinofluoran 3-(N-ethyl-N-cyclohexylamino)-6-methyl-7-anilinofluoran 3-(N-ethyl-N-xylamino)-6-methyl-7-(p-chloroanilino) fluoran 3-(N-ethyl-p-toluidino)-6-methyl-7-anilinofluoran 3-(N-ethyl-N-isoamylamino)-6-methyl-7-anilinofluoran 3-(N-ethyl-N-isoamylamino)-6-chloro-7-anilinofluoran 3-(N-ethyl-N-tetrahydrofurfurylamino)-6-methyl-7-anilinofluoran 3-(N-ethyl-N-isobutylamino)-6-methyl-7-anilinofluoran 3-(N-p-tolyl-N-ethylamino)-7-(N-phenylmethyl-N-methyl)fluoran 3-(N-ethyl-N-ethoxypropylamino)-6-methyl-7-anilinofluoran 3-N-ethyl-N-isoamylamino-benzo[a]fluoran 3-N-ethyl-N-p-methylphenylamino-7-methylfluoran 3-cyclohexylamino-6-chlorofluoran 2-(4-oxahexyl)-3-dimethylamino-6-methyl-7-anilinofluoran 2-(4-oxahexyl)-3-diethylamino-6-methyl-7-anilinofluoran 2-(4-oxahexyl)-3-dipropylamino-6-methyl-7-anilinofluoran 2-methyl-6-p-(p-dimethylaminophenyl) aminoanilinofluoran 2-methoxy-6-p-(p-dimethylaminophenyl) aminoanilinofluoran 2-chloro-3-methyl-6-p-(p-phenylaminophenyl) aminoanilinofluoran 2-chloro-6-p-(p-dimethylaminophenyl) aminoanilinofluoran 2-nitro-6-p-(p-diethylaminophenyl)aminoanilinofluoran 2-amino-6-p-(p-diethylaminophenyl)aminoanitinofluoran 2-diethylamino-6-p-(p-diethylaminophenyl) aminoanifinofluoran 2-phenyl-6-metyl-6-p-(p-phenylaminophenyl) aminoanilinofluoran 2-benzyl-6-p-(p-phenylaminophenyl) aminoanilinofluoran 2-hydroxy-6-p-(p-phenylaminophenyl) aminoanilinofluoran 3-methyl-6-p-(p-dimethylaminophenyl) aminoanilinofluoran 3-diethylamino-6-p-(p-diethylaminophenyl) aminoanilinofluoran 3-diethylamino-6-p-(p-dibutylaminophenyl) aminoanilinofluoran 2,4-dimethyl-6-[(4-dimethylamino)anilino]-fluoran <Fluorene Ttype Leuco Dyes>

3,6,6'-tris(dimethylamino)spiro[fluorene-9,3'-phthalide]

3,6,6'-tris(diethylamino)spiro[fluorene-9,3'-phthalide]

<Divinyl Type Leuco Dyes>

3,3-bis-[2-(p-dimethylaminophenyl)-2-(p-methoxyphenyl)ethenyl]-4,5,6,7-tetra bromophthalide 3,3-bis-[2-(p-dimethylaminophenyl)-2-(p-methoxyphenyl)ethenyl]-4,5,6,7-tetra chlorophthalide 3,3-bis-[1,1-bis(4-pyrrolidinophenyl)ethylen-2-yl]-4,5,6,7-tetrabromophthalide 3,3-bis-[1-(4-methoxyphenyl)-1-(4-pyrrolidinophenyl) ethylene-2-yl]-4,5,6,7-tetra chlorophthalide <Others>

3-(4-diethylamino-2-ethoxyphenyl)-3-(1-ethyl-2-methylindol-3-yl)-4-aza phthalide 3-(4-diethylamino-2-ethoxyphenyl)-3-(1-octyl-2-methylindol-3-yl)-4-aza phthalide 3-(4-cyclohexylethylamino-2-methoxyphenyl)-3-(1-ethyl-2-methylindol- 3,3-bis(1-ethyl-2-methylindol-3-yl)phthalide 3,3-bis(1-n-butyl-2-methylindol-3-yl)phtalide 3,3-bis(1-n-octyl-2-methylindol-3-yl) phtalide 3,6-bis(dietylamino)fluoran-γ-anilinolactam 3,6-bis(diethylamino)fluoran-γ-(3'-nitro)anilinolactam 3,6-bis(diethylamino)fluoran-γ-(4'-nitro)anilinolactam 1,1-bis-[2',2',2",2"-tetrakis-(p-dimethylaminophenyl)-ethenyl]-2,2-dinitdlethane 1,1-bis-[2',2',2",2"-tetrakis-(p-dimethylaminophenyl)-ethenyl]-2-β-naphthoyl ethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonicacid dimethylester.

In the present invention, as a sensitizer contained in a high temperature color developing layer, at least one kind of diphenylsuofone bridgeable type compound represented by general formula (1) is used. The diphenylsuofone bridgeable type compound represented by general formula (1) is a compound disclosed in International Publication WO97/16420 and Japanese Patent Laid Open Publication 10-29969.

In general formula (1), as the concrete examples of groups indicated by X and Y, following compounds can be mentioned. Namely, methylene group, ethylene group, trimethylene group, tetramethylene group, pentamethylene group, hexamethylene group, heptamethylene group, octamethylene group, nonamethylene group, decamethylene group, undecamethylene group, dodecamethylene group, methylmethylene group, dimethylmethylene group, methylethylene group, methyleneethylene group, ethylethylene group, 1,2-dimethylethylene group, 1-methyltnimethylene group, 1-methyltetramethylene group, 1,3-dimethyltrimethylene group, 1-ethyl-4-methyl-tetramethylene group, vinylene group, propenylene group, 2-butenylene group, ethynylene group, 2-butynylene group, 1-vinylethylene group, ethyleneoxyethylene group, tetramethyleneoxytetramethylene group, ethyleneoxyethylene group, ethyleneoxymethyleneoxyethylene group, 1,3-dioxane-5, 5-bismethylene group, 1,2-xylyl group, 1,3-xylyl group, 1,4-xylyl group, 2-hydroxytrimethylene group, 2-hydroxy-2-methyltrimethylene group, 2-hydroxy-2-ethyltrimethylene group, 2-hydroxy-2-propyltrimethylene group, 2-hydroxy-2-isopropyltrimethylene group and 2-hydroxy-2-butyltrimethylene group can be mentioned.

Alkyl group or alkenyl group of $R_1$ to $R_6$ is an alkyl group of $C_1$ to $C_6$ or an alkenyl group of $C_1$ to $C_6$, and as concrete examples, methyl group, ethyl group, n-propyl group, isopropyl group, n-butyl group, sec-butyl group, tert-butyl group, n-pentyl group, isopentyl group, neopentyl group, tert-pentyl group, n-hexyl group, isohexyl group, 1-metylpentyl group, 2-methylpentyl group, vinyl group, allyl group, isopropenyl group, 1-propenyl group, 2-butenyl group, 3-butenyl group, 1,3-butandienyl group and 2-methyl-2-propenyl group can be mentioned. And as a halogen atom, chloride, bromine, fluorine or iodine are mentioned.

In this invention, as a diphenylsulfone bridgeable type compound represented by general formula (1), several kinds of compounds whose substitution group and/or "a" number are different can be used by mixing together with, and the mixing ratio can be voluntarily selected. The mixing method is not restricted, however, substantially, mixing by powder state, mixing in aqueous solution or mixing by to producing plural kinds of diphenylsulfone bridgeable type compounds simultaneously by using specific producing method can be mentioned.

As the concrete examples of a compound represented by general formula (1), the following compounds can be mentioned.

(1-1)

4,4'-bis[4-[4-(4-hydroxyphenylsulfonyl)phenoxy]-2-trans-butenyloxy]diphenyl sulfone (1-2)

4,4'-bis[4-(4-hydroxyphenylsulfonyl)phenoxy-4-butyloxy]diphenylsulfone (1-3)

4,4'-bis[4-(4-hydroxyphenylsulfonyl)phenoxy-3-propyloxy]diphenylsulfone (1-4)

4,4'-bis[4-(4-hydroxyphenyisulfonyl)phenoxy-2-ethyloxy]diphenyisulfone (1-5)

4-[4-(4-hydroxyphenylsulfonyl)phenoxy-4-butyloxy]-4'-[4-(4-hydroxyphenyl sulfonyl) phenoxy-3-propyloxy] diphenylsulfone (1-6)

4-[4-(4-hydroxyphenylsulfonyl)phenoxy-4-butyloxy]-4'-[4-(4-hydroxyphenyl sulfonyl) phenoxy-2-ethyloxy] diphenylsulfone (1-7)

4-[4-(4-hydroxyphenylsulfonyl)phenoxy-3-propyloxy]-4'-[4-(4-hydroxyphenyl sulfonyl)phenoxy-2-ethyloxyjdiphenylsulfone (1-8)

4-4'-bis[4-(4-hydroxyphenylsulfonyl)phenoxy-5-pentyloxy]diphenylsulfone (1-9)

4,4'-bis[4-(4-hydroxyphenylsulfonyl)phenoxy-6-hexyloxy]diphenylsulfone (1-10)

4-[4-[4-hydroxyphenylsulfonyl]phenoxy]-2-trans-butenyloxy]-4'-[4-(4-hydroxy phenylsulfonyl) phenoxy-4-butyloxy]diphenylsulfone (1-11)

4-[4-(4-hydroxyphenylsulfonyl)phenoxy-2-trans-butenyloxy]-4'-[4-(4-hydroxy phenylsulfonyl) phenoxy-3-propyloxy]diphenylsulfone (1-12)

4-[4-[4-(4-hydroxyphenylsulfonyl)phenoxy]-2-trans-butenyloxy]-4'-[4-(4-hydroxy phenylsulfonyl) phenoxy-2-ethyloxy]diphenylsulfone (1-13)

1,4-bis[4-[4-[4-(4-hydroxyphenylsulfonyl)phenoxy-2-trans-butenyloxy]phenyl sulfonyl]phenoxy]-cis-2-butene (1-14)

1,4-bis[4[4-[4-(4-hydroxyphenyisulfonyl)phenoxy-2-trans-butenyloxy]phenyl sulfonyl]phenoxy]-trans-2-butene (1-15)

4,4'-bis[4-[4-(2-hydroxyphenylsulfonyl)phenoxy] butyloxy]diphenylsulfone (1-16)

4,4'-bis[4-[2-(4-hydroxyphenyisulfonyl)phenoxy] butyloxy]diphenylsulfone (1-17)

4,4'-bis[4-(4-hydroxyphenylsulfonyl)phenoxy-2-ethylenoxyethoxyldiphenyl sulfone (1-18)

4,4'-bis[4-(4-hydroxyphenylsulfonyl)phenyl-1,4-phenylenebismethyleneoxyl diphenylsulfone, (1-19)

4,4'-bis[4-(4-hydroxyphenylsulfonyl)phenyl-1,3-phenylenebismethyleneoxy]diphenylsulfone (1-20)

4,4'-bis[4-(4-hydroxyphenylsulfonyi)phenyl-1,2-phenylenebismethyleneoxy]diphenylsulfone (1-21)

2,2'-bis[4-[4-[4-(4-hydroxyphenylsulfonyl)phenoxy-2-ethyleneoxyethoxy]phenyl sulfonyl]phenoxy]diethyl ether (1-22) α, α'-bis[4-[4-[4- (4-hydroxyphenylsulfonyl)phenyl-1,4-phenylenebismethylene oxy]phenylsulfonyl]phenoxy]-p-xylene (1-23)

α,α'-bis[4-[4-[4-(4-hydroxyphenylsulfonyl)phenyl-1,3-phenylenebismethylene oxy]phenylsulfonyl]phenoxy]-m-xylene (1-24)

α,α'-bis[4-[4-[4-(4-hydroxyphenylsulfonyl)phenyl-1,2-phenylenebismethylene oxy]phenylsulfonyl]phenoxy]-0-xylene (1-25)

2,4'-bis[2-(4-hydroxyphenylsulfonyl)phenoxy-2-ethyleneoxyethoxy]diphenylsulfone (1-26)

2,4'-bis[4-(2-hydroxyphenylsulfonyl)phenoxy-2-ethyleneoxyethoxy]diphenylsulfone (1-27)

4,4'-bis[3,5-dimethyl-4-(3,5-dimethyl-4-hydroxyphenylsulfonyl)phenoxy-2-ethylene oxyethoxy]diphenylsulfone (1-28)

4,4'-bis[3-allyl4-(3-allyl-4-hydroxyphenylsulfonyl) phenoxy-2-ethyleneoxyethoxy]diphenylsulfone (1-29)

4,4'-bis[3,5-dimethyl-4-(3,5-dimethyl-4-hydroxyphenylsulfonyl)phenyl-1,4-phenylenebismethyleneoxy]diphenylsulfone (1-30)

4,4'-bis[3,5-dimethyl-4-(3,5-dimethyl-4-hydroxyphenylsulfonyl)phenyl-1,3-phenylenebismethyleneoxy]diphenylsulfone (1-31)

4,4'-bis[3,5-dimethyl-4-(3,5-dimethyl-4-hydroxyphenylsulfonyl)phenyl-1,2-phenylenebismethyleneoxy]diphenylsulfone (1-32)

4,4'-bis[3-allyl-4-(3-allyl-4-hydroxyphenylsulfonyl)1,4-phenylenebismethylene oxy]diphenylsulfone (1-33)

4,4'-bis[3-allyl-4-(3-allyl-4-hydroxyphenylsulfonyl)1,3-phenylenebismethylene oxy]diphenylsulfone (1-34)

4,4'-bis[3-allyl-4-(3-allyl-4-hydroxyphenylsulfonyl)1,2-phenylenebismethylene oxy]diphenylsulfone (1-35)

4,4'-bis[4-(4-hydroxyphenylsulfonyl)phenoxy-2-hydroxypropyloxy]diphenyl sulfone (1-36)

1,3-bis[4-[4-[4-(4-hydroxyphenylsulfonyl)phenoxy-2-hydroxypropyloxy]phenyl sulfonyl]phenoxyl-2-hydroxypropane.

In a case to use by mixing several kinds of diphenylsulfone bridgeable type compound represented by general formula (1), the most desirable composition is the composition containing more than two kinds of compound represented by general formula (3) only whose "a" values are different. The preparation methods of these kind of compounds are not so complicated, and by altering the reaction ratio of materials the compounds whose "a" values are different can be synthesized by voluntary containing ratio at one time.

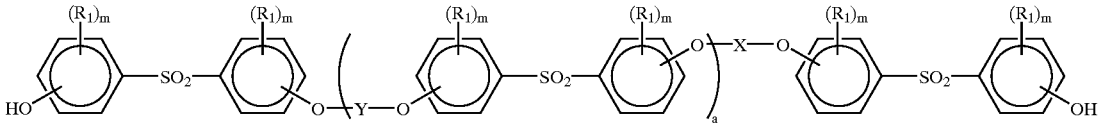

(3)

In this formula, X, Y, $R_1$, m and a is same as to mentioned above.

Among the compounds represented by general formula 3, especially the compound of a=0 is a compound disclosed in WO93/06074 and WO95/33714, and as the concrete example, 1,3-bis[4-(4-hydroxyphenylsulfonyl)phenoxy]-2-hydroxypropane, 1,1-bis[4-(4hydroxyphenyisulfonyl)phenoxy]methane,

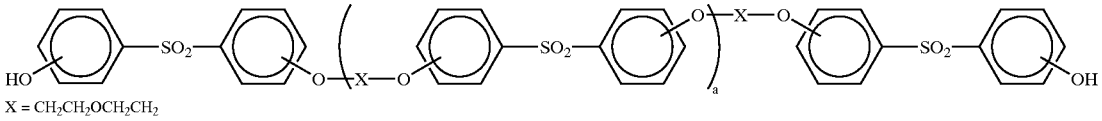

X = $CH_2CH_2OCH_2CH_2$ 1,2-bis[4-(4-hydroxyphenylsulfonyl)phenoxy]ethane, 1,3-bis[4-(4-hydroxyphenylsulfonyl)phenoxy]propane, 1,4-bis[4-(4hydroxyphenylsulfonyl) phenoxy]butane, 1,5-bis[4-(4-hydroxyphenylsulfonyl)phenoxy]pentane, 1,6-bis[4-(4-hydroxyphenylsulfonyl) phenoxy]hexane, α, α'-bis[4-(4-hydroxyphenylsulfonyl)phenoxy]-p-xylene, α, α'-bis[4-(4-hydroxyphenylsulfonyl)phenoxy]-m-xylene, α, α'-bis[4-(4-hydroxyphenylsulfonyl)phenoxy]-o-xylene, 2,2'-bis[4-(4-hydroxyphrnylsulfonyl)phenoxy]diethyl ether, 4,4'-bis[4-(4-hydroxyphenylsulfonyl)phenoxy]dibuthyl ether, 1,2-bis[4-(4-hydroxyphenylsulfonyl)phenoxy]ethylene and 1,4-bis[4-(4-hydroxyphenylsulfonyl)phenoxy]-2-butene can be mentioned.

The compound represented by general formula (1), can be obtained by the method described in International Patent Laid Open Publication WO97/16420 which reacts 4,4'-dihydroxyphenylsulfone derivatives or 2,4'-dihydroxyphenyl sulfone derivatives under the presence of basic compound. The color developer used in this invention contains one or more kinds of diphenylsulfone bridgeable type compound prepared by above mentioned method, and especially the compounds obtained by following synthetic examples are desirably used.

Synthetic Example 1

16.0 g (0.4 mole) of sodium hydroxide is added to 21.2 g of water and dissolved, and then 50.0 g (0.2 mole) of 4,4'-dihydroxydiphenylsulfone (hereinafter shortened to BPS) is added. Then, 14.3 g (0.10 mole) of bis(2-chloroethyl)ether is added at 105° C., and reacted for 5 hours at 110–115° C. After the reaction is over, 375 ml of water is added to the reacted solution, stirred for 1 hour at 90° C. Then cooled down to the room temperature, neutralized by 20% sulfuric acid. The crystallized solid is filtrated, and 39.3 g of white crystalline is obtained. The yield to bis(2-chloroethyl)ether is 88%. The obtained component is analyzed by high performance liquid chromatography and identified as follows. As the column, Mightysil RP-18 (product of Kanto Chemical Co., Ltd.) is used, and moving bed is $CH_3CN:H_2O:1\%H_3PO_4$=700:300:5, and UV wave length is 260 nm.

a=0: retention time 1.9 minutes: area % 32.9 a=1: retention time 2.3 minutes: area % 21.7 a=2: retention time 2.7 minutes: area % 12.8 a=3: retention time 3.4 minutes: area % 8.8 a=4: retention time 4.2 minutes: area % 5.8 a=5: retention time 5.4 minutes: area % 3.5 a=6: retention time 7.0 minutes: area % 2.2 a=7: retention time 9.0 minutes: area % 1.7 a=8: retention time 11.8 minutes: area % 1.3 a=9: retention time 15.4 minutes: area % 1.3

Synthetic Examples 2–4

The molar ratio of BPS and bis(2-chloroethyl)ether of Synthetic Example 1 is changed to 1.5:1, 2.5:1, 3.0:1, and following composition can be obtained.

In a case of 1.5:1, a=0; area %:20.8, a=1; area %:33.0, a=2; area %:14.2, a=3; area %:7.9, a=4; area %:3.9

In a case of 2.5:1, a=0; area %:49.6, a=1; area %:25.9, a=2; area %:11.4, a=; area %:5.3, a=4; area %:3.4

In a case of 3.0:1, a=0; area %:56.9, a=1; area %:24.9, a=2; area %:9.6, a=; area %:3.7, a=4; area %.1.3

Synthetic Example 5

In a mixed solution of 10.0 g of 48% of aqueous solution of sodium hydroxide and 155 g of N,N'-dimethylacetoamide, 30.0 g (0.12 mole) of BPS is added. After temperature is risen to 80° C. and BPS is dissolved, 10.5 g (0.06 mole) of α,α'-dichloro-p-xylene dissolved in 15 g of xylene is dropped slowly. Then, ripened for 2 hours by same temperature. After ripened, the solution is poured into 900 ml of water and the crystallized solid is filtrated. The obtained crude crystalline is rinsed by methanol, filtrated and dried up, and 19.7 g of white crystalline is obtained. Analyzed by high precision liquid chromatograph, and the main components are identified as follows.

α,α'-bis[4-(4hydroxyphenylsulfonyl)phenoxy]-p-xylene 59.1%

4,4'-bis[4-(4-hydroxyphenylsulfonyl)phenyl-1,4-phenylenebismethyleneoxy]diphenylsulfone 23.1%.

α,α'-bis[4-[4-[4-(4-hydroxyphenylsulfonyl)phenyl-1,4-phenylenebismethylene oxy] phenylsulfonyl] phenoxy]-p-xylene 11.1%

In the present invention, when diphenylsulfone bridgeable type compound represented by general formula (1) or 3-{[(phenylamine)carbonyl]amino}benzenesulfoneamide compound represented by general formula (2) are used together with as the color developer for a higher temperature color developing layer, the mixing ratio is voluntarily decided along with the desired quality and not restricted. For instance, in a case in which the image preservability of higher temperature color developed image to plasticiser is especially important, if the amount of 3-{[(phenylamine) carbonyl]amino}benzenesulfoneamide is too small, the improving effect of image stability is not sufficient, on the contrary, if it is too much, said effect is deteriorated. By containing 0.1to 0.5 parts of 3-{[(phenylamine)carbonyl] amino}benzenesulfoneamide to 1 part of diphenylsulfone bridgeable type compound a thermally sensitive recording medium whose recording sensitivity and image preservability are well balanced. When only 3-{[(phenylamine) carbonyl]amino}benzene sulfoneamide is used as the color developer for the higher temperature color developing layer, the color developed at lower temperature and the color developed at higher temperature can be clearly separated even if under the high temperature atmosphere.

In the present invention, as a color developer contained in the lower. temperature color developing layer, for instance, bisphenol A type disclosed in Japanese Patent Laid Open Publication 3-207688 and Japanese Patent Laid Open Publication 5-24366, 4-hydroxybenzoic acid ester type, 4-hydroxyphtalic acid diester type, phtalic acid monoester type, bis-(hydroxyphenyl)sulfide type, 4-hydroxyphenylarylsulfone type, 4-hydroxyphenylarylsulfone type, 4-hydroxyphenylarylsulfonate type, 1,3-di[2-(hydroxyphenyl]-2-propyl]-benzene type, 4-hydroxybenzoyloxybenzoic acid ester type, bisphenol sulfone type, derivatives of aminobenzenesulfoneamide disclosed in Japanese Patent Laid Open Publication 8-59603 and diphenylsulfone bridgeable type compound disclosed in WO97/16420 can be mentioned. These mentioned color developers can be voluntarily chosen according to the desired recording sensitivity and other properties.

The typical examples of well-known color developer are mentioned below, however, not limited to them.

<Bisphenol A Type>

4,4'-isopropylidenediphenol (another name is bisphenol A)

4,4'-cyclohexylidenediphenol p,p'-(1-methyl-normalhexylidene)diphenol 1,7-di(hydroxyphenylthio)-3,5-dioxaheptane <4-Hydroxybenzoic Acid Ester Type>

4-hydroxybenzyl benzoate 4-hydroxyethyl benzoate 4-hydroxypropyl benzoate 4-hydroxyisopropyl benzoate 4-hydroxybutyl benzoate 4-hydroxyisobutyl benzoate 4-hydroxymethylbenzyl benzoate.

<4-Hydroxyphthalic Acid Diester Type>

4-hydroxydimethylphthalate 4-hydroxydiisopropylphthalate 4-hydroxydibenzylphthalate 4-hydroxydihexylphthalate <Phthalic Acid Monoester Type> monobenzyl phthalate monocyclohexyl phthalate monophenyl phthalate monomethylphenyl phthalate monoethylphenyl phthalate monopropylbenzyl phthalate monohalogenbenzyl phthalate monoethoxybenzyl phthalate <bis-(Hydroxyphenyl)sulfide Type> bis-(4-hydroxy-3-tert-butyl-6methylphenyl)sulfide bis-(4-hydroxy-2,5-dimethylphenyl)sulfide bis-(4-hydroxy-2-methyl-5-ethylphenyl)sulfide bis-(4-hydroxy-2-methyl-5-isopropylphenyl)sulfide bis-(4-hydroxy-2,3-dimethylphenyl)sulfide bis-(4-hydroxy-2,5-dimethylphenyl)sulfide bis-(4-hydroxy-2,5-diisopropylphenyl)sulfide bis-(4-hydroxy-2,3,6-trimethylphenyl) sulfide bis-(2,4,5-trihydroxyphenyl)sulfide bis-(4-hydroxy-2-cyclohexyl-5-methylphenyl)sulfide bis-(2,3,4-trihydroxyphenyl)sulfide bis-(4,5-dihydroxy-2-tert-butylphenyl)sulfide bis-(4-hydroxy-2,5-diphenylphenyl)sulfide bis-(4-hydroxy-2-tert-octyl-5-methylphenyl)sulfide <4-Hydroxyphenylarylsulfone Type>

4-hydroxy-4'-isopropoxydiphenylsulfone 4-hydroxy-4'-n-propoxydiphenylsulfone 4-hydroxy-4'-n-butyloxydiphenylsulfone <4-Hydroxyphenylarylsulfonate Type>

4-hydroxyphenylbenzenesulfonate 4-hydroxyphenyl-p-tolylsulfonate 4-hydroxyphenylmethylenesulfonate 4-hydroxyphenyl-p-chlorobenzenesulfonate 4-hydroxyphenyl-p-tert-butylbenzenesulfonate 4-hydroxyphenyl-p-isopropoxybenzenesulfonate 4-hydroxyphenyl-1'-naphthalenesulfonate 4-hydroxyphenyl-2'-naphthalenesulfonate <1,3-di[2-(Hydroxyphenyl)-2-propyl]benzene Type>

1,3-di[2-(4-hydroxyphenyl)-2-propyl]benzene 1,3-di[2-(4-hydroxy-3-alkylphenyl)-2-propyl]benzene 1,3-di[2-(2,4-dihydroxyphenyl)-2-propyl]benzene 1,3-di[2-(2-hydroxy-5-methylphenyl)-2-propyl]benzene <Resorcinol Type>

1,3-dihydroxy-6(α,α-dimethylbenzyl)-benzene.

<4-Hydroxybenzoyloxybenzoic Acid Ester Type>

4-hydroxybenzoyloxybenzyl benzoate 4-hydroxybenzoyloxymethyl benzoate 4-hydroxybenzoyloxyethyl benzoate 4-hydroxybenzoyloxypropyl benzoate 4-hydroxybenzoyloxybutyl benzoate 4-hydroxybenzoyloxyisopropyl benzoate 4-hydroxybenzoyloxytert-butyl benzoate 4-hydroxybenzoyloxyhexyl benzoate 4-hydroxybenzoyloxyoctyl benzoate 4-hydroxybenzoyloxynonyl benzoate
4-hydroxybenzoyloxycyclohexyl benzoate
4-hydroxybenzoyloxy β-phenethyi benzoate
4-hydroxybenzoyloxyphenyl benzoate
4-hydroxybenzoyloxy α-naphthyl benzoate
4-hydroxybenzoyloxy β-naphthyl benzoate
4-hydroxybenzoyloxysec-butyl benzoate <Bisphenolsulfone Type (I)> bis-(3-1-butyl-4-hydroxy-6-methylphenyl)sulfone
bis-(3-ethyl-4-hydroxyphenyl)sulfone
bis-(3-propyl-4-hydroxyphenyl)sulfone
bis-(3-methyl-4-hydroxyphenyl)sulfone
bis-(2-isopropyl-4-hydroxyphenyl)sulfone
bis-(2-ethyl-4-hydroxyphenyl)sulfone
bis-(3-chloro-4-hydroxyphenyl)sulfone
bis-(2,3-dimethyl-4-hydroxyphenyl)sulfone
bis-(2,5-dimethyl-4-hydroxyphenyl)sulfone
bis-(3-methoxy-4-hydroxyphenyl)sulfone
4-hydroxyphenyl-2'-ethyl-4'-hydroxyphenylsulfone
4-hydroxyphenyl-2'-isopropyl-4'-hydroxyphenyisulfone
4-hydroxyphenyl-3'-isopropyl-4'-hydroxyphenylsulfone
4-hydroxyphenyl-3'-sec-butyl-4'-hydroxyphenylsulfone
3-chloro-4-hydroxyphenyl-3'-isopropyl-4'-hydroxyphenylsulfone
2-hydroxy-5-t-butylphenyl-4'-hydroxyphenyi sulfone
2-hydroxy-5-t-aminophenyl-4'-hydroxyphenylsulfone
2-hydroxy-5-t-isopropylphenyl-4'-hydroxyphenylsulfone
2-hydroxy-5-t-octylphenyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-2'-methyl-4'-hydroxyphenylsulfone <Bisphenolsulfone Type (II)>

4,4'-sulfonyidiphenol
2,4'-sulfonyidiphenol
3,3'-dichloro-4,4'-sulfonyidiphenol
3,3'-dibromo-4,4'-sulfonyldiphenol
3,3',5,5'-tetrabromo-4,4'-sulfonyildiphenol
3,3'-diamino-4,4'-sulfonyidiphenol <Others> p-tert-butylphenol
2,4-dihydroxybenzophenone
novolac type phenolic resin
4-hydroxyacetophenone
p-phenylphenol
benzyl-4-hydroxyphenylacetate
p-benzylphenol
4,4'-bis(p-tolylsulfonylaminocarbonilamino) diphenylmethane
4,4'-bis(phenylaminotiocarbonylamino)diphenylsufide Additionally, as an image forming material, metallic chelete type color developing components composed of higher fatty acid metal complex salt and polyhibric hydroxyaromatic compound disclosed in Japanese Patent Laid Open Publication 10-258577 can be used. Still more, these chelete color developing components can be used alone or can be used together with said leuco dye and color developer.

In this invention, a conventional well known sensitizer can be blended to each color developing layer so as to adjust the recording sensitivity, in the limitation in which the desired effect of this invention is not prevented. As an example of the sensitizer,
stearic acid amide,
palmitic acid amide,
methoxycarbonyl-N-benzamidestearate,
N-benzoyl stearic acid amide,
N-icosenic acid amide,
ethylene-bis-stearic acid amide,
behenic acid amide,
methylene-bis-stearic acid amide,
methylolamide,
N-rmethylolsteric acid amide,
dibenzyl terephthalate,
dimethyl terephthalate,
dioctyl terephthalate,
p-benzyloxybenzylbenzoate,
1-hydroxy-2-phenylnaphthoate,
dibenzyloxalate
di-p-methylbenzyloxalate,
di-p-chlorobenzyloxalate,
2-naphthylbenzylether,
m-tarphenyl,
p-benzylbiphenyl,
4-biphenyl-p-tolylether,
di(p-methoxyphenoxyethyl)ether,
1,2-di(3-methylphenoxy)ethane,
1,2-di(4-methylphenoxy)ethane,
1,2-di(4-methoxyphenoxy)ethane,
1,2-di(4-chlorophenoxy)ethane,
1,2-diphenoxyethane,
1-(4-methoxyphenoxy)-2-(2-methylphenoxy)ethane,
p-methylthiophenylbenzylether,
1,4-di(phenylthio)buthane,
p-acetotoluidide,
p-acetophenetidide,
N-acetoacetyl-p-toluidine,
di-(β-biphenylethoxy)benzene,
p-di(vinyloxyethoxy)benzene,
1-isopropylphenyl-2-phenylethane
1,2-bis(phenoxymethyl)benzene
p-toluenesulfonamide,
o-toluenesulfonamide,
di-p-tolylcarbonate and
phenyl-α-naphtylcarbonate can be mentioned, however is not intended to be limited to these compounds.

These sensitizer can be used alone or by mixing more than two kinds of them.

As a binder to be used in the present invention, full saponificated polyvinyl alcohol of 200–1900 polymerization degree, partial saponificated polyvinyl alcohol, denatured polyvinyl alcohol by carboxyl, denatured polyvinyl alcohol by amide denatured polyvinyl alcohol by sulfonic acid, denatured polyvinyl alcohol by butylal modified polyvinyl alcohol, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be illustrated. These macromolecule compounds can be applied by being dissolved into solvents such as water, alcohol, ketone, ester or hydrocarbon or by being dispersed in water or other medium under an emulsion state or a paste state and these forms of application can be used in combination according to the quality requirement.

As a filler which can be used in this invention, an inorganic or an organic filler such as silica, calcium carbonate, kaoline, calcined kaoline, diatomaceous earth, talc, titanium dioxide, zinc oxide, aluminum hydroxide, polystyrene resin, urea-formaldehyde resin, copolymer of styrene-methacrylic acid, copolymer of styrene-butadiene or hollow plastic pigments can be mentioned.

If it is necessary to obtain more vivid color tone to a higher temperature color developing layer, it is effective to reduce the blending ratio of filler in higher temperature color developing layer or not to blend it. The reason why is presumed as follows. That is, in a case of color adding type, the color developing compound (reacted product of leuco dye and color developer, namely color developed image) formed in a higher temperature color developing layer at high temperature heating does not stay only in the higher temperature color developing layer and is absorbed in filler contained in a lower temperature color developing layer, then mixed effectively with the color developing compound formed in the lower temperature color developing layer, thus the higher temperature developed color tone, which is a mixed color, is obtained.

Still more, a parting agent such as metallic salt of fatty acid, a slipping agent such as waxes, an ultraviolet ray absorbing agent such as benzophenone type or triazole type, a water proof agent such as glyoxal, a dispersing agent, a defoamer, an antioxidant and a fluorescent brightening agent can be used.

As a substrate of the thermally sensitive recording medium, paper, recycled paper, synthetic paper, plastic film, foamed plastic film, non-woven cloth and metal foil can be used, further a complex sheet that combines these materials can be used.

Further, for the purpose to improve the friction resistance, it is possible to prepare an over coating layer composed of high polymer on the surface of the thermally sensitive recording layer. Furthermore, for the purpose to improve the sensitivity, it is possible to prepare an under coating layer containing organic or inorganic fillers between a color developing layer and a substrate.

The amount of color developer and leuco dye, the kind and amount of other additives to be used to each thermally sensitive recording layers of this invention are decided according to the required quality and recording feature, and not restricted. However, in general, it is preferable to use 0 to 4 parts of filler to 1 part of color developer, and the desirable amount of a binder is 5 to 25% to the total amount of solid. Further, it is desirable to contain 0.1 to 2 parts of leuco dye to 1 part of color developer.

Still more, in a case to use leuco dye which develops multi tone color in a higher temperature color developing layer and to obtain a complex tone color by high temperature heating, it is effective to make the amount of dye in the higher temperature color developing layer 0.5 to 3 parts, desirably 0.6 to 2.0 parts to 1 part of dye contained in the lower temperature color developing layer. And in a case to use a dye which develops mono tone color in a higher temperature color developing layer and in a lower temperature color developing layer and the color tone developed at high temperature heating is complex tone color, the ratio of each mono tone color type dye of higher temperature color developing layer and lower temperature color developing layer can be voluntarily adjusted according to the desired color tone.

In the present invention, the coating amount of each color developing layers are not restricted, however, ordinary are adjusted in the region of 1.5 to 12 g/m$^2$ by dry weight. Still more, in the present invention, it is possible to prepare a middle layer between higher temperature color developing layer and lower temperature color developing layer. In the coating which forms said middle layer, a binder, a filler, a sensitizer, a defoamer, an antioxidant, an UV absorber and a fluorescent brightening agent can be voluntarily blended. The coating amount of a middle layer can be adjusted between the region of 1 to 10 g/m$^2$.

Said organic color developer, dye and other additives which are added when needs arises, and are ground to the fine particles smaller than several microns diameter by means of a pulverizer such as a ball mill, an attriter or a sand grinder, or by means of an adequate emulsifying apparatus, then a binder and other additives are added when needs arises, thus the coating is prepared. As the concrete examples of a coating method, a coating by hand, a sizing press coater method, a roll coater method, an air knife coater method, a blend coater method, a flow coater method, a comma direct method, a gravure direct method, a gravure reverse method and a reverse-roll coater method can be mentioned. Or, it is possible to dry up the medium after spraying or dissolving the coating.

EXAMPLE

Preparation of Thermally Sensitive Recording Medium

The thermally sensitive recording medium of this invention will be illustrated more concretely by Examples, however, not intended to be limited to them. In the Examples and Comparative Examples, parts and % indicates weight part and weight %.

Example 1

Example 1 is an example that uses in a lower temperature color developing layer, 4-hydroxy-4'-isopropoxydiphenylsulfone as a color developer and 3,3-bis (p-dimethylaminophenyl)-6-dimethylaminophtalide (blue color developing leuco dye) as a leuco dye, and in a higher temperature color developing layer, the compound of synthetic example 1 as a color developer, 3-(N-ethyl-p-toluidino)-6-methyl-7-anilinofluoran (black color developing leuco dye) as a leuco dye.

Dispersion of color developer for a lower temperature color developing layer (A solution), dispersion of leuco dye which develops blue color (B solution), dispersion of color developer for a lower temperature color developing layer (C solution) and dispersion of leuco dye which develops black color (D solution) are separately ground in wet condition to average particle diameter of 1 $\mu$m by a sand grinder.

| | |
|---|---|
| A solution (dispersion of color developer) | |
| 4-hydroxy-4'-isopropoxydiphenylsulfone | 6.0 parts |
| 10% polyvinyl alcohol | 18.8 parts |
| water | 11.2 parts |
| B solution (dispersion of blue color leuco dye) | |
| 3,3-bis(p-dimethylaminophenyl)-6-dimethylaminophtalide | 1.0 parts |
| 10% polyvinyl alcohol | 2.3 parts |
| water | 1.3 parts |
| C solution (dispersion of color developer) | |
| compound of synthetic Example 1 | 6.0 parts |
| 10% polyvinyl alcohol | 18.8 parts |
| water | 11.2 parts |
| D solution (dispersion of black color leuco dye) | |
| 3-(N-ethyl-p-toluidino)-6-methyl-7-anilinofluoran | 1.0 parts |
| 10% polyvinyl alcohol | 2.3 parts |
| water | 1.3 parts |

Then above mentioned dispersions are mixed by following ratio, stirred and dispersions are prepared.

[Preparation of a Coating for a Lower Temperature Color Developing Layer]

| | |
|---|---|
| A solution (dispersion of color developer) | 36.0 parts |
| B solution (dispersion of blue color leuco dye) | 13.8 parts |
| $SiO_2$ pigment (25% dispersion; Mizucasil P-527 (product of Mizusawa Chemical) | 40 parts |
| 10% polyvinyl alcohol | 20 parts |
| [preparation of a coating for a higher temperature color developing layer] | |
| C solution (dispersion of color developer) | 36.0 parts |
| D solution (dispersion of black color leuco dye) | 13.8 parts |
| $SiO_2$ pigment (25% dispersion; Mizucasil P-527 (product of Mizusawa Chemical) | 20 parts |
| 10% polyvinyl alcohol | 20 parts |

The prepared coating for a higher temperature color developing layer is coated on one side of substrate paper of 50 g/m$^2$ paper so as the coating amount to be 5.0 g/m$^2$ and dried, and then over said surface the coating prepared for a lower temperature color developing layer is coated so as the coating amount to be 4.0 g/m$^2$. Then the obtained sheet is treated by a super calendar so as the smoothness to be 500 to 600 sec., thus the multi chromatic thermally sensitive recording medium is obtained.

Example 2

A thermally sensitive recording medium is prepared same as to the Example 1. However, at the preparation of a high temperature color developing layer, $SiO_2$ pigment is not added.

Example 3

A thermally sensitive recording medium is prepared same as to the Example 2. At the preparation of A solution, 2,4'-sulfonyldiphenol is used instead of 4-hydroxy-4'-isopropoxydiphenylsulfone.

Examples 4, 5

A thermally sensitive recording medium is prepared same as to the Example 2. At the preparation of B solution, 3-(4-diethlamino-2-ethoxyphenyl)-3-(1-ethyl-2-methylindol-3-yl)-4-azaphthalide (blue color developing leuco dye; Example 4), 3,3-bis(1-n-butyl-2-methylindol-3-yl)phthalide (red color developing leuco dye; Example 5) are used instead of 3,3-bis(p-dimethylaminophenyl)-6-dimethylaminophtalide.

Example 6

A thermally sensitive recording medium is prepared same as to the Example 2. At the preparation of C solution the compound of Synthetic Example 2 is used instead of the compound of Synthetic Example 1.

Examples 7, 8

A thermally sensitive recording medium is prepared same as to the Example 2. At the preparation of D solution, 3-dibutylamino-7-(o-chloroanilino) fluoran (black color developing leuco dye; Example 7), 3-dibutylamino-6-methyl-7-anilinofluoran (black color developing leuco dye; Example 8) are used instead of 3-(N-ethyl-p-toluidino)-6-methyl-7-anilinofluoran.

Example 9

A thermally sensitive recording medium is prepared same as to the Example 2. At the preparation of C solution 3-{[(phenylamine)carbonyl]amino}benzenesulfoneamide is used instead of the compound of Synthetic Example 1.

Example 10

A thermally sensitive recording medium is prepared same as to the Example 2. At the preparation of a coating for high temperature color developing layer, 3 parts of 3-{[(phenylamine)carbonyl]amino}benzenesulfoneamide dispersion (E solution) is added.

E Solution (Dispersion of Color Developer)

| | |
|---|---|
| 3-{ [(phenylamine)carbonyl] amino}benzene-sulfoneamide | 6.0 parts |
| 10% polyvinyl alcohol | 18.8 parts |
| water | 11.2 parts |

Examples 11, 12, 13

A thermally sensitive recording medium is prepared same as to the Example 10. At the preparation of a coating for high temperature color developing layer, the adding amount of E solution is changed to 6 parts (Example 11), 18 parts (Example 12) and 27 pats (Example 13).

Comparative Example 1

A thermally sensitive recording medium is prepared same as to the Example 7. At the preparation of C solution, 4,4'-sulfonyidiphenol(bisphenol S) is used instead of the compound of Synthetic Example 1.

<Method for Evaluation>

Thermal recording is carried out on the prepared thermally sensitive recording media using Thermal sensitive printer (thermal head of ROHM Co., Ltd. type KM2004-A3 is installed), which is a product of MARKPOINT Co., Ltd.

Printed by 0.076 mj/dot impressive energy for lower temperature color developing and printed by 0.219 mj/dot impressive energy for higher temperature color developing. Image density of recorded part is measured by means of a Macbeth densitometer (RD-914). At the measurement by Macbeth densitometer, red filter is used for blue color image, green filter is used for red color image and amber filter is used for black color image and ground part color.

As the heat resistance test, prepared lower temperature color developed specimen is placed in dry high temperature atmosphere of 65° C. for 24 hrs and the color tone of lower temperature color developed part (0.076 mj/dot) is inspected by naked eyes of the inspector, further degree of color developing of ground part is evaluated by Macbeth densitometer.

Resistance to plasticiser test is carried out as follows. A single sheet of polyvinylchloride wrap (HIGHWRAP KMA: Mitsui Toatsu Chemicals Co., Ltd.) is wound round with 1 ply on a paper tube, stuck thereon a specimen developed by higher temperature (0.219 mj/dot) so as the recorded part to be upper surface, further wound round with 3 plies of the polyvinylchloride wrap, allowed to stand at 40° C. for 24 hours, and measured the Macbeth density of the recorded part. The obtained results are summarized in Table 1 and Table 2.

TABLE 1

| | 0.076 mj/dot | | 0.219 mj/dot | |
|---|---|---|---|---|
| Example | color tone | O.D.(image) | color tone | O.D.(image) |
| 1 | blue | 1.16(R) | bluish black | 1.34(A) |
| 2 | blue | 1.17(R) | black | 1.35(A) |
| 3 | blue | 1.17(R) | black | 1.35(A) |
| 4 | blue | 1.21(R) | black | 1.38(A) |
| 5 | red | 1.22(G) | black | 1.32(A) |
| 6 | blue | 1.16(R) | black | 1.33(A) |
| 7 | blue | 1.16(R) | black | 1.32(A) |
| 8 | light navy blue | 1.20(R) | black | 1.35(A) |
| 9 | blue | 1.10(R) | black | 1.34(A) |
| 10 | blue | 1.18(R) | black | 1.35(A) |
| 11 | blue | 1.20(R) | black | 1.37(A) |
| 12 | blue | 1.20(R) | black | 1.37(A) |
| 13 | blue | 1.21(R) | black | 1.36(A) |
| Co. Exp. 1 | blue | 1.09(R) | black | 1.36(A) |

TABLE 2

| | heat resistance | | plasticiser resistance |
|---|---|---|---|
| Example | color tone | O.D.(ground part) | O.D.(image) |
| 1 | dark blue | 0.08(A) | 0.76(A) |
| 2 | dark blue | 0.08(A) | 0.78(A) |
| 3 | dark blue | 0.08(A) | 0.74(A) |
| 4 | dark blue | 0.09(A) | 0.85(A) |
| 5 | dark red | 0.07(A) | 0.81(A) |
| 6 | dark blue | 0.09(A) | 0.71(A) |
| 7 | dark blue | 0.06(A) | 0.74(A) |
| 8 | navy blue | 0.08(A) | 0.84(A) |
| 9 | blue | 0.06(A) | 0.20(A) |
| 10 | dark blue | 0.08(A) | 0.81(A) |
| 11 | dark blue | 0.08(A) | 1.00(A) |
| 12 | dark blue | 0.08(A) | 0.91(A) |
| 13 | dark blue | 0.07(A) | 0.70(A) |
| Co. Exp. 1 | black | 0.15(A) | 0.02(A) |

(Remarks) in Tables, marks in parenthesis indicates the type of filter of Macbeth densitometer.
R: red filter, G: green filter, A: amber filter <Evaluation Results>

From the Examples 1 to 13 of the present invention, sufficient recording density and clear color tone are obtained both on the results by lower impressive energy (0.076 mj/dot) and by higher impressive energy (0.219 mj/dot). After the heat resistance test, fogging of the lower energy printed part (fogging of black color) and color developing of the ground part are slight, and color separation is clearly maintained, therefore, these products obtained by said Examples can be practically used. Especially, Example 9 that uses 3-{[(phenylamine)carbonyl]amino}benzenesulfoneamide alone indicates excellent result on heat resistance. Further, Examples 1 to 8 that use diphenylsulfone bridgeable type compound represented by general formula (1) are superior in the preservability of color developed image by high temperature. In Examples 10 to 13 that use diphenylsulfone bridgeable type compound together with 3-{[(phenylamine)carbonyl]amino}benzenesulfoneamide indicate good preservability of color developed image by high temperature. Especially, Examples 11 and 12 in which 0.1to 0.5 parts of 3-{[(phenylamine)carbonyl]amino}benzenesulfoneamide is used to 1 part of diphenylsulfone bridgeable type compound, indicate excellent preservability of color developed image by high temperature. On the contrary, by the Comparative Example 1 that uses a color developer not specified in the present invention, sufficient results are obtained from the view point of recording density and color separation, however, the image printed at lower energy can not maintain it's initial clear color tone under the high temperature atmosphere and changes to black color, furthermore, the color developing of ground part is remarkable, and inferior in heat resistance and preservability of color developed image by high temperature.

Effect of the Invention

The thermally sensitive recording medium of the present invention indicates good recording density at every developed color tone and clear developed color tone can be obtained. And, even if exposed under high temperature condition, it shows very clear color separation. Still more, since the color developing of ground part is small, the preservability of color developed image by high temperature is excellent, the present invention is suited to the uses which require heat resistance and image preservability and can be said very useful for the practical use.

What is claimed is:

1. A multi chromatic thermally sensitive recording medium comprising, a higher temperature color developing layer containing dye precursor and an organic color developer that reacts with said dye precursor and develops color by heating, and at least one lower temperature color developing layer that develops different color from that of said higher temperature color developing layer and develops color by lower temperature than the color developing temperature of said higher temperature color developing layer laminated in order on a substrate, wherein an organic color developer contained in said higher temperature color developing layer contains diphenylsulfone bridgeable type compound represented by general formula (1), (1)

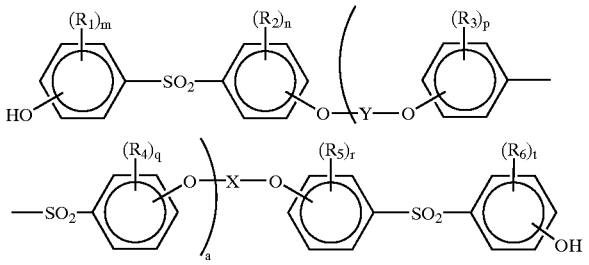

wherein, X and Y can be different and indicates a saturate or an unsaturated liner or grafted hydrocarbon group of carbon number 1 to 12 which can possess an ether bond, or (a)

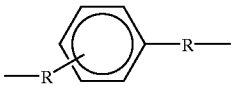

or, (b)

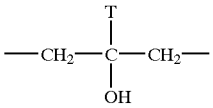

wherein R indicates a methylene group or an ethylene group, T indicates a hydrogen atom or an alkyl group of carbon number 1 to 4, and $R_1$ to $R_6$ independently indicate a halogen atom, an alkyl group of carbon number 1 to 6 or an alkenyl group, further m, n, p, q, r, t indicate an integer number of 0 to 4 and when are bigger than 2, $R_1$ to $R_6$ can be different and a is an integer of 0 to 10.

2. A multi chromatic thermally sensibve recording medium preparing a higher temperature color developing layer containing dye precursor and an organic color developer that reacts with said dye precursor and develops color by heating, and at least one lower temperature color developing layer that develops different color from that of said higher temperature color developing layer and develops color by lower temperature than the color developing temperature of said higher temperature color developing layer laminated in order on a substrate, wherein an organic color developer contained in said higher temperature color developing layer contains 3-{[(phenylamine)carbonyl]amino}benzenesulfone amide compound represented by general formula (2), (2)

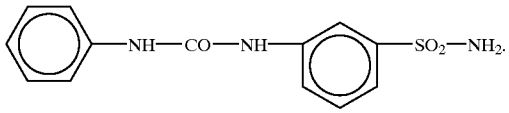

3. A multi chromatic thermally sensitive recording medium preparing a higher temperature color developing layer containing dye precursor and an organic color developer that reacts with said dye precursor and develops color by heating, and at least one lower temperature color developing layer that develops different color from that of said higher temperature color developing layer and develops color by lower temperature than the color developing temperature of said higher temperature color developing layer laminated in order on a substrate, wherein an organic color developer contained in said higher temperature color developing layer contains said diphenylsulfone bridgeable type compound represented by general formula (1) and said 3-{[(phenylamine)carbonyl]amino}benzenesulfoneamide compound represented by general formula (2).

* * * * *